United States Patent [19]

Okubo et al.

[11] Patent Number: 4,992,117

[45] Date of Patent: Feb. 12, 1991

[54] HEAT RESISTANT ALUMINUM ALLOY EXCELLENT IN TENSILE STRENGTH, DUCTILITY AND FATIGUE STRENGTH

[75] Inventors: Yoshimasa Okubo; Kazuhisa Shibue; Hideo Yoshida, all of Nagoya, Japan

[73] Assignee: Sumitomo Light Metal Industries, Ltd., Tokyo, Japan

[21] Appl. No.: 340,124

[22] Filed: Apr. 18, 1989

[30] Foreign Application Priority Data

Mar. 20, 1989 [JP] Japan ..... 1-66239

[51] Int. Cl.[5] ..... C22C 21/00

[52] U.S. Cl. ..... 148/439; 420/534; 420/535

[58] Field of Search ..... 420/534, 535; 148/439

[56] References Cited

FOREIGN PATENT DOCUMENTS 62-238346 10/1987 Japan .
1-108337 4/1989 Japan .
1-108338 4/1989 Japan .

*Primary Examiner*—R. Dean
*Attorney, Agent, or Firm*—Flynn, Thiel, Boutell & Tanis

[57] ABSTRACT

The present invention provides a heat resistant alloy having a composition consisting essentially of, in weight percentages, 4 to 12% of Fe, 1 to less than 4.0% of Si, 1 to 6% of Cu, 0.3 to 3% of Mg, and the balance aluminum and incidental impurities. The aluminum alloy may further contain one or more elements selected from 0.5 to 5 wt. % of V, 0.5 to 5 wt. % of Mo and 0.4 to 4 wt. % of Zr, the total content of these components not exceeding 8 wt. %. Since the heat-resistant aluminum alloys have a superior combination of properties of high tensile strength, good ductility and high fatigue strength at elevated temperatures up to 200° C. as well as moderate temperatures, they can be applied to structural members, such as connecting rods, of internal combustion engines, thereby considerably reducing the weight of such structural components. The use of the alloys results in an increased output power and high efficiency in the internal combustion engines.

2 Claims, No Drawings

HEAT RESISTANT ALUMINUM ALLOY EXCELLENT IN TENSILE STRENGTH, DUCTILITY AND FATIGUE STRENGTH

BACKGROUND OF THE INVENTION

1. Field of the Invention

This invention relates to heat resistant aluminum alloys excellent in tensile strength, ductility and fatigue strength, especially notch fatigue strength which alloys are especially suited to use in structural members of internal combustion engines, such as connecting rods and movable valve members (e.g. valve lifter, valve spring retainer, rocker arm, etc.).

2. Description of the Prior Art

As energy-saving measures in automobiles, motor cycles etc., it is strongly requested to lighten the weight of them. Particularly, if structural members of the internal combustion engines, particularly connecting rods become light, significantly improved high-performance engines will be expected. Under such circumstances, it is highly desired to prepare the connecting rods and other parts using aluminum materials.

The connecting rods are ordinarily employed in the temperature range of from room temperature to 150° C., and particularly, in internal combustion engines under a high load, they are employed at nearly 200° C. Therefore, it is required that the connecting rod materials have sufficient tensile strength, ductility and fatigue strength for use in the temperature range of from room temperature to 200° C. Besides such properties, it is also significant that the modulus of elasticity is high and the coefficient of thermal expansion is low. Among such requirements, ductility and notch fatigue srength are especially important.

Even the alloys designated AA 2218 and AA 2618, which are considered to be superior in high temperature strength, are still insufficient in tensile strength and fatigue strength, especially notch fatigue strength (fatigue strength in notched materials) at elevated temperatures of 150 ° C. or higher. For this, aluminum alloys have been scarcely used in the connecting rods, etc., and only steel materials have been employed.

However, as described above, since the internal combustion engines are considerably improved in the efficiency by lightening the weight of the structural members, mainly connecting rods, it is still strongly desired to produce the connecting rods or other members from aluminum alloy.

In response to such demands, Applicant's Assignee has previously proposed Al-Fe-V-Mo-Zr alloy materials containing dispersoids whose size is controlled, the alloys being superior in tensile strength and fatigue strength at elevated temperatures (Japanese Patent Application Laid-Open No. 62-238 346).

The above-mentioned materials have been prepared by powder metallurgy techniques. The materials are usually used in the as-forged state or after cutting off flash formed at mating faces of a metal mold by a chipping process. However, in such a surface state, the surface roughness and microcracks constitute notches, and thereby may cause a reduction in fatigue strength. Further, if the connecting rods are subjected to an unusual load, ruptures or breakages will rapidly occur due to lack of ductility. Therefore, the reliability of the parts becomes low.

The aluminum alloy material previously proposed in Japanese Patent Application Laid-Open No. 62-238 346 has a high tensile strength but has a low fatigue strength.

SUMMARY OF THE INVENTION

It is accordingly an object of the present invention to improve the alloys as mentioned above and provide aluminum alloys which are superior in tensile strength at elevated temperatures, at least up to 200° C., ductility and fatigue strength, especially notch fatigue strength.

According to a first aspect of the present invention, there is provided a heat resistant alloy which is superior in tensile strength, ductility and fatigue strength, the alloy having a composition consisting essentially of, in weight percentages:

Fe: from 4 to 12%,
Si: from 1 to less than 4.0%,
Cu: from 1 to 6%,
Mg: from 0.3 to 3%, and
the balance aluminum and incidental impurities.

In accordance to another aspect of the present invention, there is provided a heat resistant aluminum alloy excellent in tensile strength, ductility and fatigue strength which contains, in addition to the alloying components as specified in the first aspect, one or more elements selected from 0.5 to 5 wt. % of V, 0.5 to 5 wt. % of Mo and 0.4 to 4 wt. % of Zr, the total content of these components not exceeding 8 wt. %.

Since the heat-resistant aluminum alloys of the present invention have high tensile strength, good ductility and high fatigue strength at elevated temperatures as well as moderate temperatures, they can be applied to structural memberers of internal combustion engines, such as connecting rods, rocker arms, valve lifters, valve spring retainers, etc. Such applicaition will considerably reduce the weight of the structural members, mainly the connecting rods, and provide increased output power and high efficiency in the internal combustion engines.

DESCRIPTION OF THE PREFERRED EMBODIMENTS

The reason why the heat resistant aluminum alloy is limited to the composition as specified above is described below. All percentages (%) given in the specification refer to percentages by weight (wt. %) unless otherwise indicated.

Fe: Fe is dispersed as $Al_3Fe$, $Al_6Fe$, Al-Fe system metastable phase or Al-Si-Fe system compounds and offers improved tensile strength and fatigue strength, particularly notch fatigue strength. Further, Fe is effective for achieving a high modulus of elasticity and a reduced coefficient of thermal expansion. If the Fe content is less than 4%, the strength and fatigue strength, particularly notch fatigue strength of resulting alloys are insufficient. On the other hand, amounts of Fe exceeding 12% will result in an inadequate ductility, thereby presenting difficulties in hot forging.

Si: Si is dispersed as Al-Si-Fe system compounds which are formed in coexistence with Fe and enhances, ductility and fatigue strength, particularly notch fatigue strength. Further, the modulus of elasticity is increased and the coefficient of thermal expansion is decreased. When the Si content is less than 1%, the Al-Si-Fe system compounds can not be obtained in sufficient amounts and ductility, and fatigue strength, particularly notch fatigue strength are low. Further, the coefficient of thermal expansion will become unfavorably increased. Amounts of Si of 4.0% or more result in formation of excessive amounts of the Al-Si-Fe system compounds and Si may be also existent as Si particles. Due to this, not only the tensile-strength increasing effect is saturated, but also ductility and notch fatigue strength will be decreased.

Cu: Cu offers an age-hardening effect in combination with Mg. The age-hardening effect results in improved tensile strength and fatigue strength, particularly notch fatigue strength. Amounts of Cu of less than 1%, are insufficiently effective, while amounts exceeding 6% produce deterious effects in hot-workability during extrusion, forging, etc., and deteriorate the corrosion resistance.

Mg: Mg offers age-hardening effect in combination with Cu. The age-hardening effect will improve the tensile strength, ductility and fatigue strength, particularly notch fatigue strength. Amounts of Mg of less than 0.3% are insufficiently effective, while, in amounts exceeding 3%, the improving effect is saturated.

V and Mo: These elements are dispersed as Al-Fe-V, Al-Fe-Mo or Al-Fe-V-Mo system compounds in combination with Fe, thereby improving the tensile strength and fatigue strength, particularly at elevated temperatures. Amounts of these elements of less than the specified lower limits are insufficiently effective, while, in amounts above the upper limit, the effect is saturated and the material cost is increased.

Zr: Zr combines with Al to form Al-Zr system compounds and improves the tensile strength and fatigue strength, especially at high temperatures. Further, Zr prevents coarsening of Al-Fe, Al-Fe-V, Al-Fe-Mo and Al-Fe-V-Mo system compounds. Amounts of Zr of less than the specified lower limit are insufficiently effective, while, in amounts above the upper limit, the effect is saturated and the material cost is increased.

V+Mo+Zr: When the total amount of V, Mo and Zr exceeds 8%, the effects is saturated and hot-workability during forging, etc., is detrimentally effected.

Other elements: Although Mn, Ni, Zn, Cr, Ti, Co, Y, Ce, Nb, etc., may be added, excessive addition of these elements adversely affect the ductility and hot-workability.

The alloy of the present invention can be produced by a variety of processes, and generally they are produced preferably in the manner described below.

An aluminum alloy having the alloy composition as specified above is melted and the resultant molten alloy is rapidly solidified. The greater the cooling rate of the solidification, the finer the compound particles will be. As a result, the fatigue strength, particularly notch fatigue strength will be improved. Usually, the alloys are rapidly solidified at a cooling rate of at least 100 ° C./sec. As a practical method for such rapid solidification, there may be used, for example, gas atomizing, single-roll quenching, twin-roll quenching, spray roll quenching, etc.

The rapidly solidified product in the form of powder, flake or ribbon thus obtained is cold-compressed into a green compact and, then, consolidated, for example, by steps of degassing and hot extruding; steps of degassing, hot-pressing and hot extruding; or steps of degassing and hot pressing. Thereafter, the consolidated alloy is shaped into the desired forms, such as connecting rod and rocker arm, by hot-forging. Finally, the shaped article is heat-treated. In such a manner, there can be obtained aluminum alloy materials having dispersoids whose size is not exceeding 10 μm.

The degassing step is carried out at temperatures of 300° to 520 ° C. When the degassing temperature is less than 300 ° C., moisture removal is insufficient. This results in reduction in strength, particularly fatigue strength, and causes blistering and formation of pores. The degassing temperature exceeding 520° C. will permit dispersoids to coarse, thereby leading to an unfavorable reduction in the fatigue strength, especially notch fatigue strength. Further, although the degassing step is most preferably carried out in a vacuum, $N_2$ gas, Ar gas or air may be also employed as an atmosphere for this step.

The hot pressing and hot extruding steps are performed while heating the billets at 300° to 500° C. At tempertures below 300° C., the billets can not be successfully processed due to high deformation resistance. On the other hand, at temperatures exceeding 500° C., extrusions are cracked.

In the alloy composition of the present invention, Al-Si-Fe system compounds do not coarse during the consolidation processing and dispersoid size can be controlled to 10 μm or less.

The hot forging step is conducted at temperatures of 400° to 500° C. When this step is carried out at temperatures of lower than 400° C. or of higher than 500° C., forgings are cracked.

The heat-treatment step is required to enhance the tensile strength and fatigue strength, particularly notch fatigue strength. The heat-treatment may be performed by various conditions (T4, T6 and T7). These heat treatments are conducted according to the similar condition of ordinary aluminum alloys. However, hardening by hot water or overaging by tempering at relatively high temperatures may be also practiced in order to reduce quenching strain and residual stress.

Now, the present invention will be described in more detail with reference to the following Example.

EXAMPLE

Aluminum alloys having the compositions shown in Table 1 were melted and atomized by air to provide rapidly solidified powder. The cooling rate of the rapid solidifiction was in the range of from $10^2$ to $10^4$ °C./sec. The obtained powder was classified so as to obtain a powder size of 149 um or less and cold pressed into green compacts of 65 to 73% of theoretical density, which having a diameter of 63 mm and a length of 150 mm. The green compacts were put into aluminum capsules and then degassed at 450° C. in a pressure of $10^{-1}$ to $10^{-2}$ Torr. Then the aluminum capsules were sealed and the green compacts were hot pressed in a metal mold. There were obtained billets having a density of 100% of the theoretical density. After cooling, the aluminum capsules were scalped. Thereafter, the billets were heated to 430° C. and there were obtained extruded rods, 18 mm in diameter, by indirect extrusion (extrusion ratio: 15). Subsequently, the extruded rods were subjected to solution heat treatment for one hour at 480° C., water-quenching and aging treatment for five hours at 175° C. (T6 treatment).

Tensile strength test were performed on the alloy materials at room temperature and 200° C (holding time for the tensile strength test at 200° C.: 100 hours). Further, notch rotating bending fatigure test was performed at room temperature (stress concentration factor $K\tau=3.1$, stress amplitude $\sigma=11$ kgf/mm$^2$).

The results are shown in Table 1.

TABLE 1

| Alloy | Composition (parts by weight) | | | | | | | | Mechanical Property at room temperature | | | Mechanical Property at 200° C. for 100 hrs. | | | Fatigue Life |
|---|---|---|---|---|---|---|---|---|---|---|---|---|---|---|---|
| No. | Al | Fe | Si | Cu | Mg | V | Mo | Zr | $\sigma_{0.2}$ | $\sigma_B$ | $\delta$ | $\sigma_{0.2}$ | $\sigma_B$ | $\delta$ | *1 |
| 1 | bal. | 7.7 | 2.2 | 4.3 | 0.3 | — | — | — | 47.2 | 51.8 | 8.0 | 22.0 | 28.5 | 17.6 | $4.7 \times 10^6$ |
| 2 | bal. | 9.0 | 2.8 | 1.9 | 1.0 | — | — | — | 35.7 | 50.9 | 9.0 | 21.7 | 24.6 | 22.9 | $5.7 \times 10^6$ |
| 3 | bal. | 8.3 | 1.5 | 2.1 | 1.1 | — | — | — | 33.0 | 45.0 | 7.4 | 20.1 | 23.8 | 19.6 | $1.8 \times 10^6$ |
| 4 | bal. | 8.1 | 3.5 | 2.0 | 1.0 | — | — | — | 35.2 | 53.9 | 7.5 | 20.1 | 22.5 | 21.9 | $2.3 \times 10^6$ |
| 5 | bal. | 11.8 | 1.5 | 2.0 | 0.3 | 3.0 | — | — | 50.8 | 56.6 | 3.7 | 29.2 | 33.2 | 12.3 | $6.3 \times 10^6$ |
| 6 | bal. | 10.9 | 3.2 | 2.1 | 1.1 | 0.8 | — | — | 52.1 | 59.3 | 2.2 | 30.0 | 37.2 | 12.1 | *2 |
| 7 | bal. | 8.1 | 3.5 | 2.5 | 1.4 | 4.2 | — | — | 53.3 | 61.2 | 2.6 | 30.9 | 35.3 | 11.7 | $1.0 \times 10^7$ |
| 8 | bal. | 8.4 | 1.6 | 2.5 | 0.9 | — | 1.3 | — | 46.0 | 52.6 | 6.4 | 25.1 | 29.4 | 15.3 | $1.4 \times 10^6$ |
| 9 | bal. | 7.8 | 2.1 | 2.8 | 2.5 | — | 4.5 | — | 50.6 | 60.1 | 2.0 | 29.2 | 33.1 | 13.5 | $6.1 \times 10^6$ |
| 10 | bal. | 9.5 | 2.3 | 2.9 | 2.9 | — | — | 3.4 | 48.5 | 61.4 | 2.1 | 29.8 | 34.6 | 12.0 | $5.3 \times 10^6$ |
| 11 | bal. | 8.1 | 2.0 | 1.8 | 1.1 | 2.2 | — | 0.7 | 52.8 | 64.3 | 2.0 | 27.5 | 33.4 | 23.0 | $7.5 \times 10^6$ |
| 12 | bal. | 7.8 | 3.6 | 2.0 | 0.8 | 2.0 | — | 0.9 | 53.3 | 62.1 | 2.2 | 27.0 | 33.1 | 23.4 | $8.0 \times 10^6$ |
| 13 | bal. | 5.4 | 1.4 | 1.6 | 0.8 | 0.8 | — | 2.0 | 44.9 | 49.2 | 10.3 | 21.5 | 27.0 | 12.8 | $3.3 \times 10^6$ |
| 14 | bal. | 8.0 | 3.7 | 2.1 | 0.9 | 1.6 | 2.2 | 0.9 | 51.0 | 59.7 | 2.5 | 27.8 | 34.4 | 16.9 | $4.4 \times 10^6$ |
| 15 | bal. | 6.2 | 3.6 | 3.7 | 1.3 | 2.1 | 0.9 | 1.1 | 49.1 | 55.8 | 3.2 | 26.5 | 33.0 | 14.1 | $8.9 \times 10^6$ |
| 16 | bal. | 14.5 | 1.5 | 2.7 | 1.0 | — | — | — | 50.6 | 55.8 | 0.9 | 36.2 | 39.9 | 1.3 | $8.9 \times 10^6$ |
| 17 | bal. | 8.0 | 6.0 | 2.0 | 1.1 | 2.1 | — | 1.0 | 55.7 | 64.4 | 0.9 | 26.7 | 32.8 | 14.1 | $8.5 \times 10^6$ |
| 18 | bal. | 6.5 | 2.2 | 8.1 | 1.5 | — | — | — | 45.3 | 52.3 | 1.4 | 20.4 | 27.2 | 4.8 | $4.2 \times 10^6$ |
| 19 | bal. | 8.5 | 0.3 | 2.2 | 0.9 | — | — | — | 25.4 | 39.7 | 5.2 | 18.1 | 23.5 | 29.5 | $8.4 \times 10^5$ |
| 20 | bal. | 8.3 | 6.0 | 1.9 | 1.2 | — | — | — | 35.3 | 50.3 | 1.2 | 19.1 | 23.3 | 17.5 | $5.5 \times 10^6$ |
| 21 | bal. | 7.5 | 2.7 | 3.3 | 4.2 | — | — | — | 38.4 | 42.5 | 2.5 | 19.7 | 23.0 | 21.7 | $6.6 \times 10^6$ |
| 22 | bal. | 3.3 | 3.5 | 2.8 | 1.2 | — | 1.9 | — | 44.1 | 48.1 | 10.1 | 17.5 | 19.1 | 20.7 | $4.2 \times 10^5$ |
| 23 | bal. | 9.2 | 0.2 | 2.4 | 0.9 | 2.3 | — | 1.1 | 46.3 | 52.4 | 0.6 | 22.6 | 28.9 | 22.5 | $2.4 \times 10^6$ |
| 24 | bal. | 7.2 | 6.7 | 4.5 | 0.6 | — | — | 1.7 | 52.7 | 57.0 | 0.3 | 23.0 | 25.3 | 8.5 | $6.1 \times 10^6$ |
| 25 | bal. | 8.9 | 2.8 | 0.2 | 0.1 | 2.1 | — | — | 42.9 | 51.7 | 7.3 | 22.5 | 31.0 | 7.4 | $1.3 \times 10^4$ |
| 26 | bal. | 8.0 | 0.3 | 0.3 | 0.2 | 1.8 | 2.1 | 0.8 | 44.7 | 49.5 | 1.2 | 31.5 | 36.8 | 4.9 | $4.7 \times 10^4$ |
| 27 | bal. | 5.8 | 2.4 | 1.9 | 1.2 | 3.4 | 3.3 | 1.8 | — | 58.0 | 0 | 34.9 | 40.6 | 0.9 | $7.8 \times 10^4$ |

Remark:
*1: Number of cycles until rupture ($\sigma = 11$ kgf/mm$^2$, $K_T = 3.1$)
*2: no fracture occurred until $1.0 \times 10^7$ cycles
Alloy Nos. 1 to 15: Alloys of the present invention
Alloy Nos. 16 to 27: Comparative alloys
$\sigma_{0.2}$: Proof Strength (kgf/mm$^2$)
$\sigma_B$: Tensile Strength (kgf/mm$^2$)
$\delta$: Elongation (%)

As can be seen from Table 1, Alloy Nos. 1 to 15 according to the present invention showed high tensile strength levels, namely, at least 45 kgf/mm$^2$ at room temperature and at least 22.5 kgf/mm$^2$ at 200° C. Further, these alloys showed high degrees of elongation, i.e., at least 2% at room temperature and at least 12% at 200° C. The alloys of the present invention showed a long fatigue life (number of cycles until ruptures occurred) exceeding $1 \times 10^6$ in the notch fatigue test.

In contrast to the test results of the invention aluminum alloys, Alloy No. 16 showed a poor elongation (ductility), i.e., 0.9% at room temperature and 1.3% at 200° C., because of an excessive Fe content of 14.5%.

Since Alloy No. 22 containing 1.9% of Mo as an optional component has an insufficient Fe content of 3.3%, the alloy showed a low tensile strength of 19.1 kgf/mm$^2$ at 200° C. and a low fatigue strength of $4.2 \times 10^5$.

Since Alloy No. 17 which contains 2.1% of V and 1.0% of Zr as optional componets has an excessive amount of Si of 6.0%, it showed an inadequate elongation (ductility) of 0.9% at room temperature.

Alloy No. 20 had a low elongation of 1.2% at room temperature, due to an excessive amount of Si of 6.0%.

Alloy No. 24 containing Zr as an optional element in amount of 1.7% contains an excessive amount of Si of 6.7% and, thus, the degrees of elongation were insufficient, i.e., 0.3% at room temperature and 8.5% at 200° C., although the tensile strength and fatigue strength reached satisfactory levels.

Alloy No. 19 had a low tensile strength of 39.7 kgf/mm$^2$ at room temperature and a low fatigue strength of $2.4 \times 10^5$ because of the insufficient Si content level of 0.3%.

Alloy No. 23 contains optional elements of V in an amount of 2.3% and Zr in an amount of 1.1% and the Si content is reduced to 0.2%. Such an insuffcient Si content resulted in a low elongation of 0.6% at room temperature, although the tensile strength and fatigue strength were at satisfactory levels.

Alloy No. 18 showed low levels of elongation, 1.4% at room temperature and 4.8% at 200 ° C., due to the high Cu content of 8.1%.

Alloy No. 21 contains a large amount of Mg of 4.2% but such a high Mg content is excluded from the range of the invention alloy composition, because, in spite of the increased Mg content, any further improvement with respect to tensile strength, elongation (ductility) and fatigue strength can not be expected.

In Alloy No. 25 containing 2.1% of V as an optional component, the Cu content and Mg content are lower than the ranges specified by the present invention. The comparative aluminum alloy showed an inadequate elongation of 7.4% at 200 ° C. and low fatigue strength level of $1.3 \times 10^4$.

Alloy No. 26 contains as optional components 1.8% of V, 2.1% of Mo and 0.8% of Zr. The contents of Si, Cu and Mg are all below the range of the present invention and the alloy showed a insufficient elongation, i.e., 1.2% at room temperature and 4.9% at 200° C. The fatigue strength is at a low level of $4.7 \times 10^4$.

Alloy No. 27 contains optional components V, Mo and Zr in an excessive amount of 8.5% in their total and the elongation values of 0% at room temperature and 0.9% at 200 ° C. were both low.

The above Example is described with respect to T6 treatment but almost the same results can be obtained by T4 treatment (480° C.×1 hr. water hardening), underaging treatment (480° C.×1 hr→water hardening→155° C.×2 hrs.), or overaging treatment (480° C.×1 hr.→water hardening→185×15hrs.).

What is claimed is:

1. A heat resistant aluminum alloy excellent in tensile strength, ductility and fatigue strength, said alloy having a composition consisting essentially of, in weight percentages:

Fe: from 4 to 12%,
Si: from 1 to less than 4.0%
Cu: from 1 to 6%
Mg: from 0.3 to 3% and the balance aluminum and incidental impurities, wherein said alloy has been prepared by rapidly solidifying a melt of said alloy at a cooling rate of at least 100° C./sec.

2. A heat resistant aluminum alloy excellent in tensile strength, ductility and fatigue strength, said alloy having a composition consisting essentially of, in weight percentages:

Fe: from 4 to 12%,
Si: from 1 to less than 4.0%
Cu: from 1 to 6%
Mg: from 0.3 to 3%,
one or more elements selected from the group consisting of
V: from 0.5 to 5%
Mo: from 0.5 to 5% and
Zr: from 0.4 to 4%,
the total content of V, Mo and Zr not exceeding 8%, and the balance aluminum and incidental impurities, wherein said alloy has been prepared by rapidly solidifying a melt of said alloy at a cooling rate of at least 100° C./sec.

* * * * *